United States Patent [19]

Helbling

[11] 4,013,083

[45] Mar. 22, 1977

[54] HAIR DRYER

[76] Inventor: Edward Helbling, 726 E. 10th St., Brooklyn, N.Y. 11230

[22] Filed: Oct. 8, 1975

[21] Appl. No.: 620,788

Related U.S. Application Data

[63] Continuation of Ser. No. 457,128, April 1, 1974, Pat. No. 3,911,934.

[52] U.S. Cl. ..... 132/9

[51] Int. Cl.[2] ..... A45D 20/00

[58] Field of Search ..... 132/9, 11 R, 85; 34/91–97

[56] References Cited

UNITED STATES PATENTS

| | | | |
|---|---|---|---|
| 692,105 | 1/1902 | Bausen | 34/96 |
| 2,827,060 | 3/1958 | Marty | 132/9 |
| 3,343,530 | 9/1967 | Solus et al. | 128/65 |
| 3,491,774 | 1/1970 | Carbone | 132/9 |
| 3,820,551 | 6/1974 | Lanzillotta | 132/11 R |
| R19,724 | 10/1935 | Martin | 132/9 |

*Primary Examiner*—G.E. NcNeill

*Attorney, Agent, or Firm*—Karl F. Ross; Herbert Dubno

[57] ABSTRACT

A hair brush or comb with apertures between its bristles or teeth is connected by a hose to an outlet of a blower which includes a heater for the generated airflow. The heater and the blower motor can be adjusted, independently or jointly, to provide different flow rates at a desired air temperature.

3 Claims, 7 Drawing Figures

HAIR DRYER

This is a continuation of application Ser. No. 457,128 filed Apr. 1, 1974, now U.S. Pat. No. 3,911,934.

FIELD OF THE INVENTION

My present invention relates to a hair dryer in which a hair-grooming implement has one or more outlets for hot air to be directed onto the hair of the user. Such an implement could be a simple air nozzle or, preferably, a brush or comb with air-discharge apertures between tufts or teeth projecting from its body; the apertures could also be disposed at the tips of these projections.

BACKGROUND OF THE INVENTION

It has already been proposed to provide such implements with conduits through which steam from a hot-water receptacle can be led to the discharge openings for treatment of the hair or the scalp of a user. Such systems, however, are not very practical inasmuch as — even with continuous electric heating — the water supply must be renewed from time to time and the conduit from the water bath to the implement must be short to avoid premature precipitation of the steam, thereby making it difficult for the operator to handle the brush or comb. Furthermore, care must be taken in the application of steam to a person's head in order to prevent scalding; steam, in any event, is not a suitable drying agent for hair that has been wetted.

OBJECT OF THE INVENTION

The general object of my present invention, therefore, is to provide an improved system for drying hair, advantageously during stroking with a brush or a comb.

A more particular object is to provide means in such a system for effectively controlling the temperature to which the hair to be dried is subjected.

SUMMARY OF THE INVENTION

I realize these objects, in accordance with my present invention, by the provision of a source of hot air under pressure connected through a flexible conduit to the hollow body of the apertured implement which is to come into contact with the user's hair.

According to a more particular feature of my invention, the source of hot air comprises an impeller such as a fan for generating an airflow and an air heater in cascade with the impeller. The air heater and the impeller are provided with respective controls for adjusting the heat output and the flow rate in order to provide an air stream of desired temperature and intensity. If the operator wishes to change that intensity, he may do so by adjusting the corresponding control, preferably with the aid of a floor pedal next to a customer's chair in the case of a barber shop or beauty parlor equipped with such a system. In order to maintain an optimum temperature with different flow rates, another feature of my invention provides for an optional coupling between the two controls to vary the heat output in step with the fan speed so that the preselected temperature remains substantially constant.

BRIEF DESCRIPTION OF THE DRAWING

The above and other features of my invention will now be described in detail with reference to the accompanying drawing in which.

SPECIFIC DESCRIPTION

Figure 1:
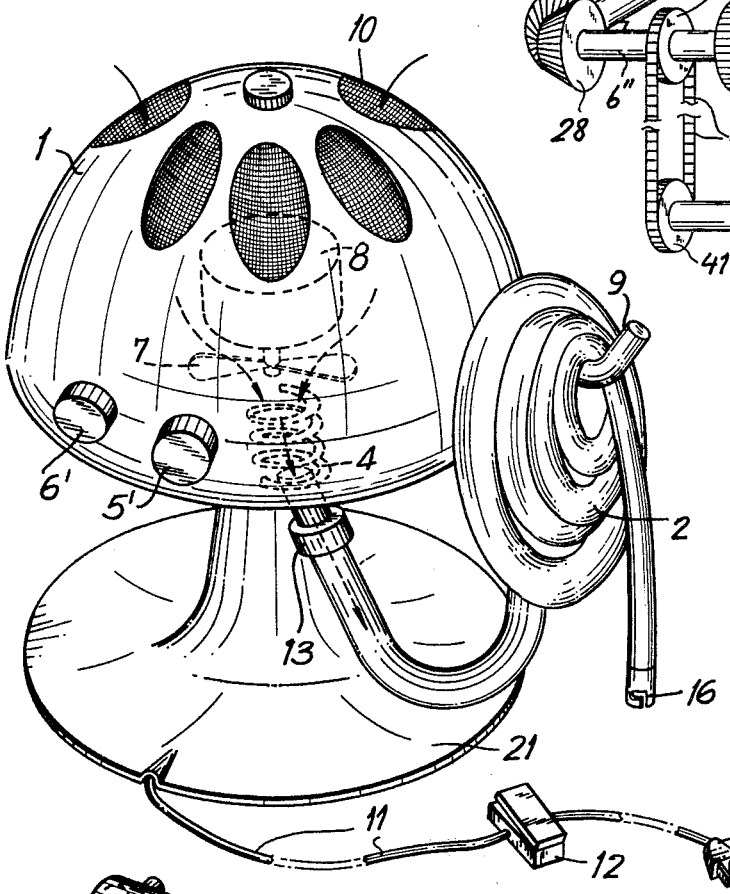
FIG. 1 is a perspective view of an air-heating unit forming an important part of a hair dryer according to my invention.

In FIG. 1 I have shown a source of hot air under pressure, comprising a generally hemispherical housing 1 with air-intake apertures 10. A heating control 4 and a fan 8 with propeller blades 7 are mounted inside the housing for driving aspirated ambient air at an elevated temperature through an outlet 3 into a flexible hose 2. The hose is provided at one end with an internally threaded collar for attachment to the outlet 3 and on the other end with a bayonet coupling 16 alternately engageable with a variety of implements shown in FIGS. 2, 3, 4 and 6. Heater 4 and fan 8 are adjustable, as described below with reference to FIG. 5, by means of a pair of control knobs 5' and 6'. Housing 1 is supported on a base 21 from which an electric cord 11, provided with a foot-operated on/off switch 12, extends to a plug 14.

I prefer to construct the housing 1 of Florentin aluminum with a baked-enamel coating which may be decoratively patterned, e.g. with a pin-stripe design. A hook 9, projecting from the housing, serves for the storage of the hose 2 in coiled-up form.

Figure 2:
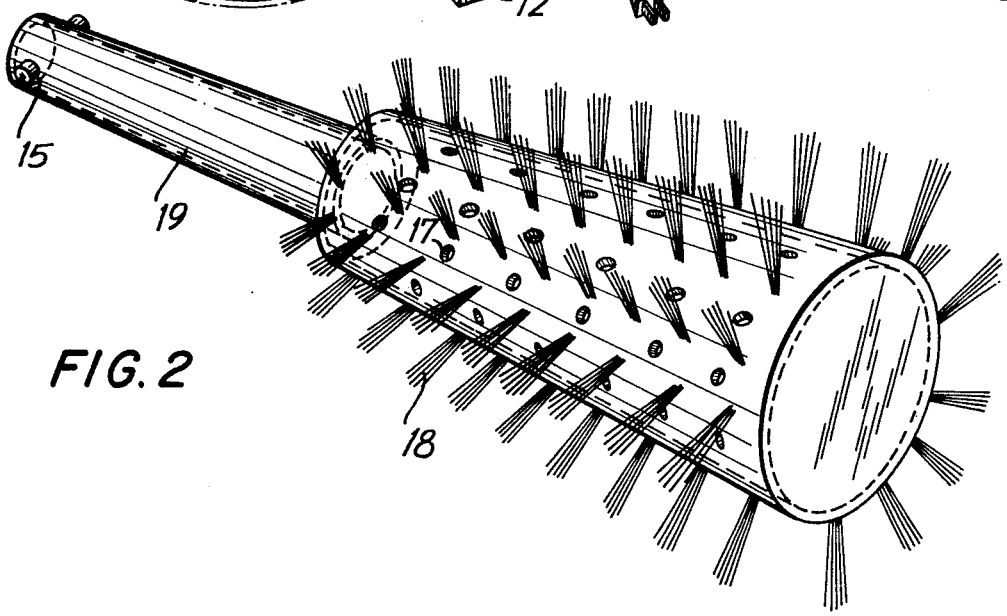
FIGS. 2, 3 and 4 are perspective views of various hair-grooming attachments (i.e. brushes) to be used with the unit of FIG. 1.

In FIG. 2 I have shown a rotary brush with a generally frustoconical body 24 on a handle 19, the body carrying tufts 18 interspersed with discharge apertures 17 for hot air introduced through the hollow handle. The latter has a bayonet coupling 15 complementary to hose coupling 16 whereby hot air from the interior of housing 1 (FIG. 1) can enter the body of the attachment and exit through the apertures 17.

Figure 3:
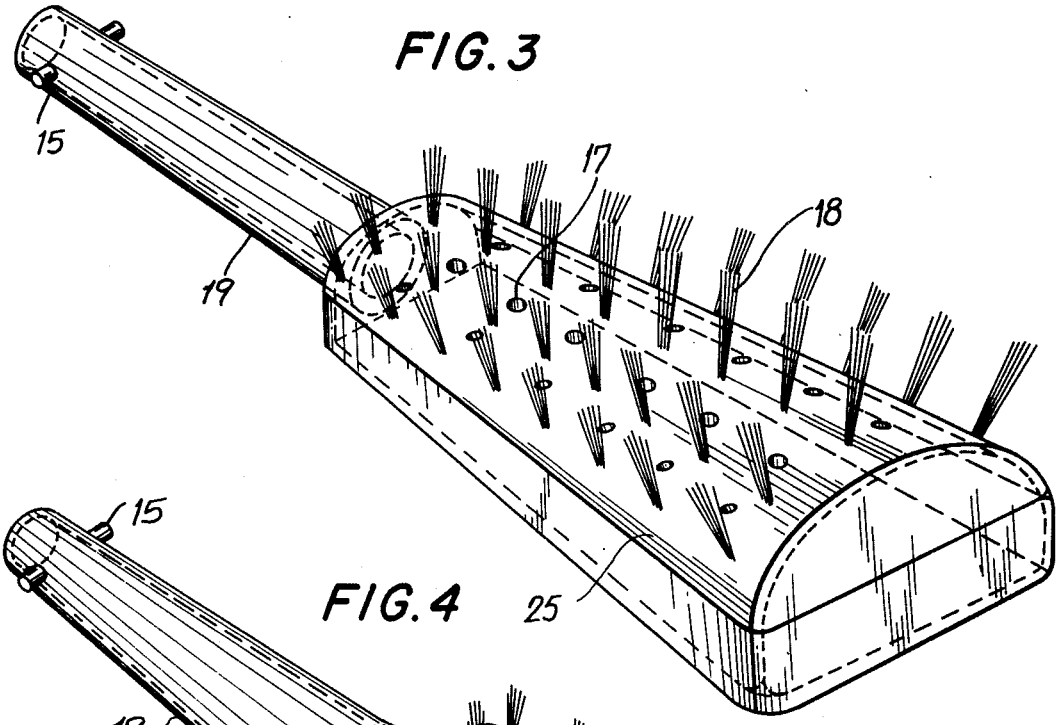
Figure 4:
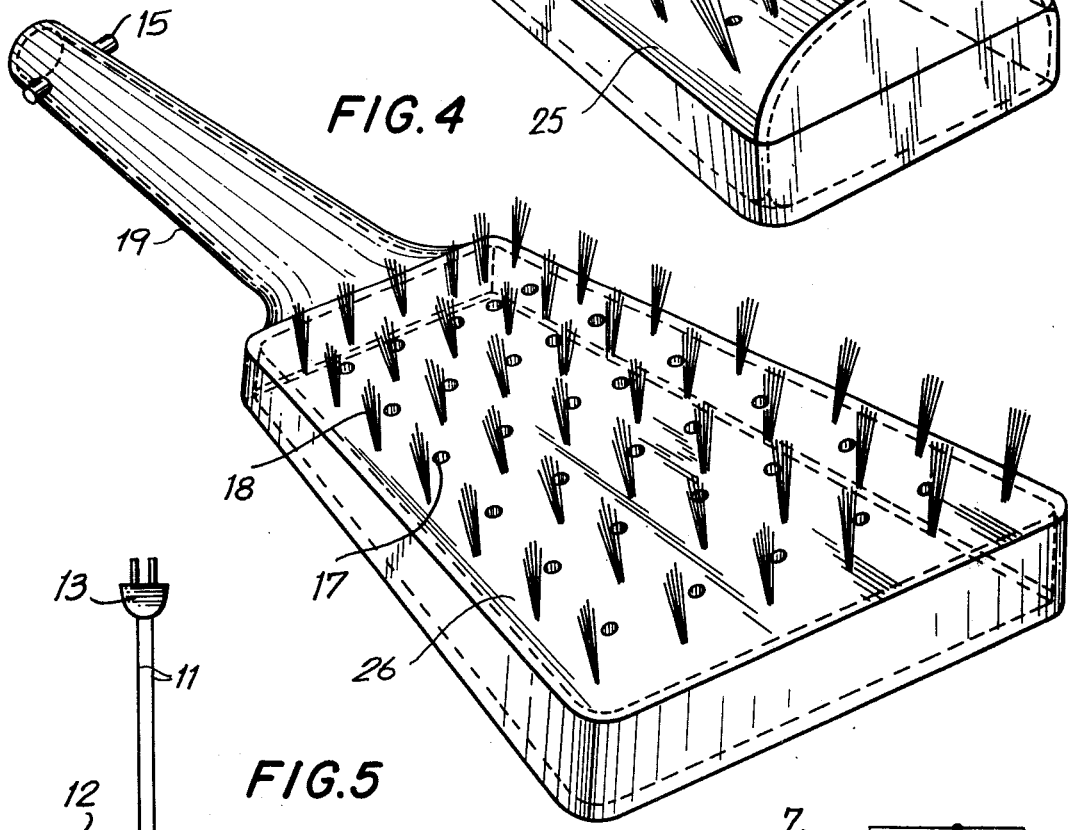

In FIG. 3 I have shown a similar brush with an upwardly convex body 25. FIG. 4 shows a flat brush body 26. The three brushes of FIGS. 2 – 4 may be interchangeably attached to the hose 2. In lieu of these brushes, a nozzle 20 shown in FIG. 6 may be so attached with the aid of the same kind of bayonet coupling 15.

Figure 5:
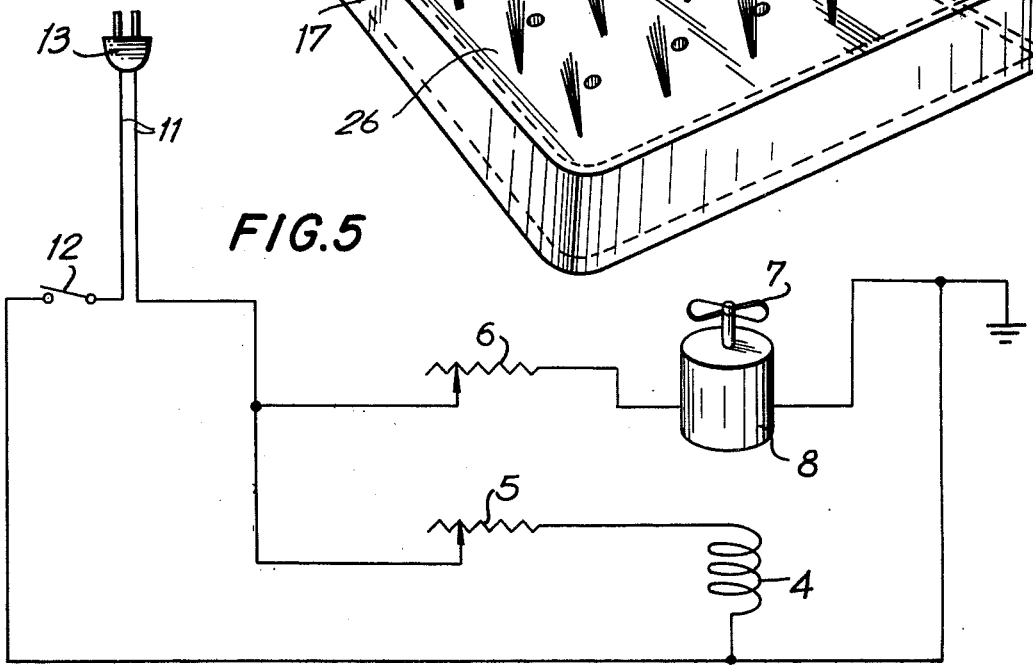
FIG. 5 is a circuit diagram for the unit of FIG. 1.

In FIG. 5 I have shown the fan 8 connected to supply line 11, in series with switch 12, via a potentiometer 6 controlled by knob 6' of FIG. 1. In an analogous manner, coil 4 is connected across the line via a potentiometer 5 controlled by knob 5' of FIG. 1.

With these controls 5, 5' and 6, 6' it is possible to select a suitable rate of heat generation and airflow within certain ranges. However, in many instances it will be desirable to maintain a temperature once selected even if the flow rate is to be changed. For this purpose the two potentiometers 5 and 6 may be mechanically interlinked as illustrated in FIG. 7.

Figure 7:
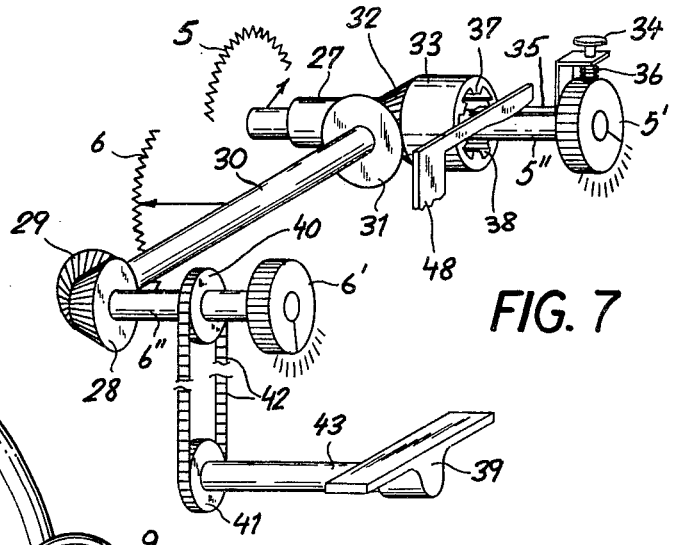
FIG. 7 is a somewhat diagrammatic representation of a coupling between heat and flow controls for the unit of FIG. 1.
Figure 6:
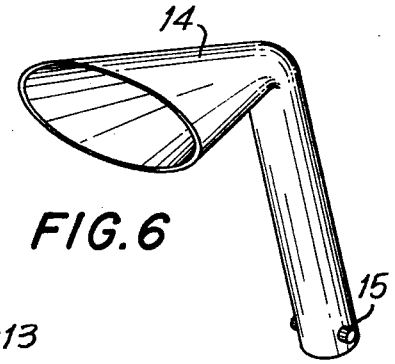
FIG. 6 is a perspective view of another attachment, i.e. an air nozzle, to be used with the unit of FIG. 1.

Knobs 5' and 6' are shown mounted in FIGS. 7 on respective shafts 5'', 6'', shaft 5'' being telescoped in a tubular shaft 27 which is integral with a bevel gear 32 and a sleeve 33 internally provided with teeth 37. Knob 5' carries a button 34, urged radially outwardly by a spring 36, which is rigid with a tongue 35 extending into the sleeve 33. With button 34 released, the free end of tongue 35 enters a groove 38 between teeth 37 so as positively to couple the knob 5' and through it the potentiometer shaft 5'' with the sleeve 33. However, a stationary cam 48 depresses the tongue 35 in an illustrated zero position in which potentiometer 5 is open-circuited so that the heating coil 4 (FIG. 5) is not energized. The several shafts are journaled in nonillustrated bearings within housing 1.

Bevel gear 32 meshes with a similar gear 31 on a shaft 30 carrying the potentiometer 5 which controls the speed of fan 8. Shaft 30 is also coupled through a pair of bevel gears 28, 29 with shaft 6'' of knob 6'. An endless chain 42 engages a pair of sprockets 40 and 41 on shaft 6'' and on an ancillary shaft 43 which is journaled in a nonillustrated mounting on base 21 (FIG. 1) and supports a reversible pedal 39. Thus, the operator may control the potentiometer 6 either by hand, via knob 6', or with the foot, via pedal 39.

With the described coupling, the fan speed may be independently adjusted with the aid of potentiometer 6 as long as the knob 5' is in its home or zero position in which shaft 30 is decoupled from shaft 5'' by the cam 48. After this initial adjustment, the operator may energize the coil 4 through the potentiometer 5 by turning the knob 5' while depressing the button 34 so as not to alter the previously selected setting of potentiometer 6. As the heat output from coil 4 increases, the temperature of the generated airflow rises until it reaches a desired level as indicated by a nonillustrated thermometer. If the operator thereupon releases the button 34, the two potentiometers remain coupled so that any reduction or augmentation of air speed results in a commensurate decrease or increase in heat output whereby the temperature of the air stream remains substantially constant.

In order to vary the temperature, the operator need only depress the button 34 and rotate the knob 5', leaving unchanged the setting of knob 6' and thus the flow rate of the air stream. Since this type of adjustment requires a conscious effort on the part of the operator, the risk of accidental temperature increases to uncomfortable levels is avoided.

A pedal as shown at 39 may, of course, also be used to control the heater potentiometer 5, either jointly with knob 5' or in place thereof.

I claim:

1. In a hair-grooming implement including a housing, impeller means in said housing for creating an airflow, heating means for said airflow in said housing in cascade with said impeller means, a hollow body with at least one outlet, and a conduit extending from said housing to said body for conveying a flow of hot air to said outlet, the combination therewith of first control means for variably energizing said heater means, second control means for variably energizing said impeller means, manual operating means coupled with one of said control means for adjusting same independently of the other of said control means, and link means for selectively coupling said other of said control means with said operating means for simultaneous adjustment of both said control means to vary the energization of said heater means and said impeller means in the same sense.

2. The combination defined in claim 1, further comprising decoupling means for making said link means ineffectual in a predetermined position of adjustment of said one of said control means.

3. The combination defined in claim 1 wherein said first and second control means comprise a pair of potentiometers.

* * * * *